United States Patent [19]

Kjaer

[11] 4,005,719

[45] Feb. 1, 1977

[54] METHOD OF SPREADING OUT TOBACCO LEAVES AND A DEVICE FOR SPREADING OUT TOBACCO LEAVES BY MEANS OF THIS METHOD

[75] Inventor: Ian Kjaer, Allerod, Denmark

[73] Assignee: A/S A. M. Hirschsprung & Sønner, Virum, Denmark

[22] Filed: Nov. 10, 1971

[21] Appl. No.: 197,246

[30] Foreign Application Priority Data

Nov. 10, 1970 Denmark ..... 5705/70

[52] U.S. Cl. ..... 131/148; 131/147 A

[51] Int. Cl.[2] ..... A24B 5/14

[58] Field of Search ..... 131/148, 147 R, 147 A, 131/124, 123

[56] References Cited

UNITED STATES PATENTS 318,549 5/1885 Dill ..... 131/147 A 973,228 10/1910 Spierer ..... 131/147 A

*Primary Examiner*—John F. Pitrelli

*Attorney, Agent, or Firm*—Stevens, Davis, Miller & Mosher

[57] ABSTRACT

Tobacco leaves to be smoothed after moistening are advanced in their transverse direction, i.e. with one side edge leading, between a pair of smoothing implements while being gripped at points adjacent to said leading side edge and near to the stalk or butt end and the point end of the leaf, respectively. The apparatus comprises a pair of upper and lower smoothing implements that are reciprocable parallel to the path of advance of the leaves and are at the same time movable relative to each other in the vertical direction between a closed, or operative, position and an open, or inoperative, position.

5 Claims, 2 Drawing Figures

FIG. 1
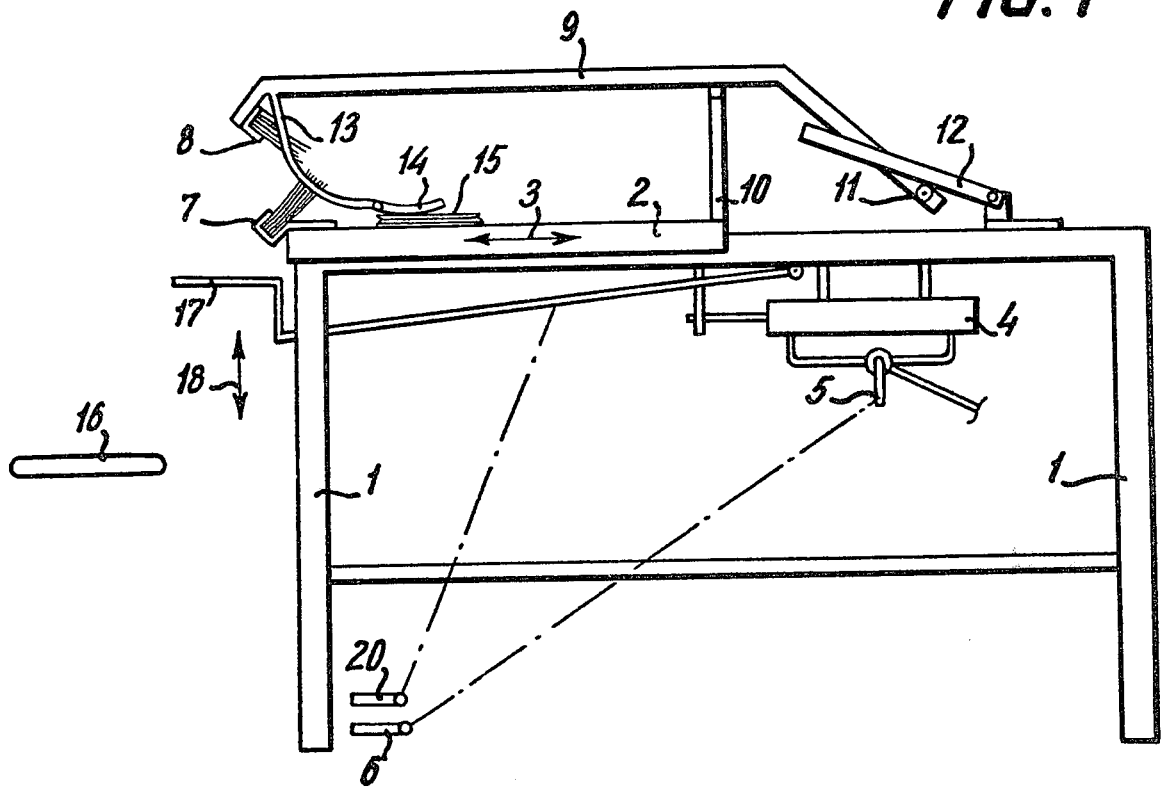
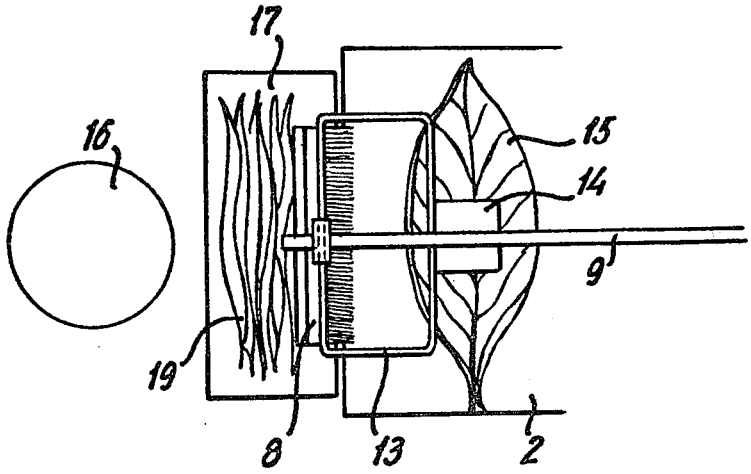
FIG. 2

METHOD OF SPREADING OUT TOBACCO LEAVES AND A DEVICE FOR SPREADING OUT TOBACCO LEAVES BY MEANS OF THIS METHOD

Subsequent to tobacco leaves having been moistened, they are, with a view to their further processing, spread out or smoothed and deposited unidirectionally so that the leaf points face the same direction, as well as being deposited with the correct side (the face or the back of the leaves, respectively) facing upwards. In connection with this operation, a sorting of the tobacco leaves may be effected, if desired.

The spreading out operation often is carried out manually in connection with a subsequent manual stemming operation. However, various mechanical auxiliary means have been developed for facilitating and expediting the operation. In the existing devices, the tobacco leaves are advanced in their longitudinal direction and, while moving in this direction the two leaf halves are, with sufficient care, brushed outwards from the midrib, which can be done while the operator directly grips the leaves manually. It is, however, also possible to perform the spreading operation by means of rotating brush rollers, the axial direction of which forms a suitable angle to the advancing direction of the leaves, or by means of compressed air nozzles that are oriented in a corresponding manner.

When the tobacco leaves are advanced in the manner stated and with the stalk end foremost, the following or trailing leave portions must normally be guided manually in order to prevent the leaf point from becoming displaced in the lateral direction in the course of the advancing movement.

Subsequent to the spreading operation, the tobacco leaves can be subjected to a stemming operation. However, in some cases this operation may be substituted by a so-called ripping-through of the tobacco leaves. By necessity, this ripping-through operation has to be performed in the direction from the leaf point end towards the stalk or butt end and it results in a division of the leaf along the midrib so that this rib, in its entirety, remains connected with the one half of the leaf. With a view to saving both time and labor, the ripping through operation should be carried out with the tobacco leaves deposited in stacks, however, if this is the case, it is a prior condition that the point ends of the tobacco leaves forming a stack, by way of example, 20 to 50 leaves, do lie exactly on top of each other. With this end in view, the tobacco leaves are, in this case, deposited with the point ends foremost.

The invention relates to a method intended for use in spreading out tobacco leaves which, subsequent to having been moistened, are smoothed out by being conducted past brushes or other smoothing implements and are thereupon passed on for further processing, such as being ripped through, cut or punched out, which method differs from the prior art in that the movement between the smoothing implements and the tobacco leaves takes place in their transverse direction while the leaves are guided by being gripped at the stalk end and point end portions.

A significant advantage in this method is that not merely the stalk ends of the leaves but also their point ends are guided positively forward to a depositing position after having passed the smoothing implements, for which reason it is easy to insure that the leaf points are placed in the depositing position with the required degree of accuracy. In this position, the leaves can be stacked on top of each other in a manner known per se, so that they are immediately ready for being ripped through.

Another advantage in the method according to the invention consists in that it is easy to inspect the leaves during the spreading operation itself as well as subsequent to their deposition, for which reason the conditions for sorting and grading the leaves become optimal. This advantage will be particularly marked when the leaves are guided by being manually gripped by the said portions at the stalk ends and the point ends, respectively, this advantage is, however, also present when the leaves are guided by mechanical means, for example, by means of movable belts.

The invention also relates to a device for spreading out tobacco leaves by the above-stated method. According to the invention, this device comprises a pair of brushes that are transversely arranged in relation to the relative direction of advance of the tobacco leaves, or corresponding smoothing implements which exert a braking effect on the tobacco leaves during, at any rate, the greater part of their laterally directed movement past the implements. When a tobacco leaf, which is gripped at one lateral edge close to the point end and the stalk end, passes the smoothing implements in its transverse direction and with said lateral edge foremost, the braking effect will result in a tractional effect in the leaf directed towards its other lateral edge which, due to the humidity in the leaf, is sufficient to ensure the desired spreading or smoothing. If actual brushes are employed, these will have to be relatively soft in order to avoid damaging the rather delicate leaf, however, as intimated, other smoothing implements may also be employed, such as relatively soft scrapers, rotating brush or fibre rollers or nozzles that emit compressed air having a movement component directed towards the rearmost lateral edge of the tobacco leaf.

The brushes may expediently be displaceable between an open position, in which they permit unimpeded passage of the foremost leaf edge and a closed position, in which they are in gliding contact with the leaf. The insertion of the leading leaf edge into the device is facilitated hereby and the risk of inadvertently folding this edge is eliminated.

The relative movement between the tobacco leaves and the smoothing implements can be brought about solely by moving the leaves, but, according to the invention, it is preferred that the brushes or the corresponding smoothing implements be mounted on a displaceable platform at its front edge facing the operator seat and are, together with the platform, displaceable towards and away from the operator. Hereby, the operator is able to dispense with the very many manual operations that will be necessary when employing stationary smoothing implements as at least the greater part of the relative movement is executed by the displaceable platform while the operator holds the leaf and possibly conducts it a little distance forward against the movement of the platform.

The manual operation becomes particularly simple to perform when the brushes or the corresponding smoothing implements from their retracted position are displaceable across a preferably height-adjustable table for tobacco leaves that are to be spread out. In this is the case, all that will be required of the operator, is, to take the tobacco leaves separately from the table and to lift them level with the smoothing implements and gradually, as the supply of tobacco leaves decreases in height, the table can be raised so that the manual lifting motion remains essentially constant.

The invention will now be more fully described with reference to the accompanying drawings, in which FIG. 1 is a somewhat simplified side elevation of an embodiment of the device according to the invention, and FIG. 2 a plan view of the foremost, that is to say the left-hand portion of the device.

The illustrated device for spreading out tobacco leaves comprises a frame 1 which, at its top, carries a platform 2 that is displaceable toward and away from the operator as indicated by a double arrow 3. This displacement movement, in the embodiment shown, is effected by means of a double-acting pneumatic cylinder 4 with a switching valve 5 which, in a manner not shown in greater detail, is controlled by a pedal 6, but the movement of the platform can, of course, also be effected and controlled in many other ways. When pedal 6 is not depressed, the platform 2 is in its retracted position shown, whereas when the pedal is depressed, the platform is pushed toward the operator a distance corresponding, by way of example, to the width of the tobacco leaf and is thereupon stationary in the advanced position for so long as the pedal is kept depressed.

At its front edge, the displaceable platform 2 carries a transversally arranged brush 7, the bristles of which point backward and upward, and a similar brush 8, the bristles of which point downward and backward, is mounted on the foremost end of a lever 9 that is carried pivotably by a stand 10 at the rear end of platform 2 and, at its rearmost end, is provided with a roller 11 that runs on the lower edge of a guiding cam or guiding rail 12 which is adjustably secured to frame 1. The cam or rail is of such a shape that the top brush 8 is lowered towards the bottom brush 7 when platform 2 is pushed toward the operator from the shown position.

In lever 9, in the area near brush 8, a freely swingable bracket 13 is suspended, the lateral arms of which extend downwardly across the intervening space between the two brushes 7 and 8 and which carries a light pressure plate 14, underneath which the successively smoothed-out or spread-out tobacco leaves 15 are stacked.

In addition, at the end of frame 1 which faces the operator seat 16, a table or apron 17 is fitted that is adjustable as to height as indicated by a double arrow 18. On apron 17, a supply of tobacco leaves 19, FIG. 2, that are to be spread out are deposited, and the purpose of the adjustability as to height is that it should be possible to gradually raise the apron as the height of the supply stack diminishes. This raising movement can be brought about by means of a mechanism (not shown) which is controlled by pressure on pedal 20.

In the shown embodiment, the device is intended for manual operation including manual holding of the tobacco leaves. The operator takes the curled-up or folded-up tobacco leaves individually from apron 17 and exposes the right-hand lateral leaf edge to the intervening space between the two brushes 7 and 8, seen from the stalk end. The operator grips the lateral edge portion with his fingers close to the stalk end and the point end and holds the leaf level with the intervening space between the two brushes 7 and 8. By pressure from pedal 6, platform 2 is set in motion towards the operator, whose fingers touch the lateral arms of freely swingable bracket 13 so that the bracket, and with it, the pressure plate 14, are raised. At the termination of the movement of the platform the now smoothed-out and spread-out leaf is located above stack 15 and it is easy for the operator to deposit the leaf in such a position that its point end coincides with the point ends of the leaves that are already stacked. A marker to indicate the correct placing of the midrib of the leaf may be provided, if desired. When pedal 6 is released, platform 2 returns to the position shown and, at the same time, plate 14 drops down on to stack 15 securing same.

When the stack 15 of spread-out tobacco leaves reaches a suitable height, it is removed from the device and can then be easily ripped through from the point end towards the stalk end.

As already intimated, the device can be supplemented with mechanical means, such as moving belts, for holding and advancing the tobacco leaves by gripping them close to their ends. In this case too, it is possible to achieve the desired, accurate positioning of the spread-out leaves behind the smoothing implements, and, when stack 15 has reached the required height, it can be ripped through as explained in the foregoing. Another possibility is to allow the spread-out leaves immediately pass on further for mechanical processing such as rolling, that is to say without their being stacked first.

I claim:

1. A device for spreading out tobacco leaves comprising a means for receiving leaves, a frame having means defining a path of advance of a leaf in a direction transverse to its stalk and point ends from the receiving means, a pair of smoothing implements movable relative to each other extending transversely of said path and arranged above and below the path in such positions as to exert a braking action on the tobacco leaf moved along said path, a platform on which said pair of smoothing implements are mounted and an operator's seat at one end of said frame, said platform being guided for reciprocating movement in said frame parallel to said path towards and away from the operator's seat.

2. The device as claimed in claim 1, including means for imparting vertical movement to one of said pair of smoothing implements in such a manner that said implements are moved towards and away from each other when said platform is moved towards and away from said operator's seat, respectively.

3. The device as claimed in claim 1, wherein the smoothing implement arranged above said path is carried by one end of a lever pivotably mounted on said platform and cooperating with guide means carried by said frame and so arranged that said implement is moved downwardly and upwardly when said platform is moved towards and away from said operator's seat respectively.

4. A device for smoothing out tobacco leaves, comprising a frame, a table for carrying a supply of leaves to be smoothed, a platform guided for reciprocating movement in said frame towards and away from said table, a stack holder for smoothed tobacco leaves associated with said platform, a pair of vertically spaced smoothing implements defining a passage through which the leaves may be carried from said table to said stack holder, and means for moving said pair of smoothing implements towards and away from each other in the vertical direction concurrently with the platform movement towards and away from said table, respectively.

5. The device as claimed in claim 4, wherein said stack holder is carried by a bracket that is pivotably mounted adjacent the smoothing implement arranged above said path, and when at rest, extends downwardly to a position so as to be swung upwardly to raise said stack holder when a tobacco leaf is introduced between said pair of implements.

* * * * *

UNITED STATES PATENT AND TRADEMARK OFFICE

CERTIFICATE OF CORRECTION

PATENT NO. : 4,005,719

DATED : February 1, 1977

INVENTOR(S) : Ian KJAER

It is certified that error appears in the above-identified patent and that said Letters Patent are hereby corrected as shown below:

[73] Assignee should read,

-- SKANDINAVISK TOBAKSKOMPAGNI A/S --
-- Rødovre, Denmark --

Signed and Sealed this

Tenth Day of April 1979

[SEAL]

Attest:

RUTH C. MASON
*Attesting Officer*

DONALD W. BANNER
*Commissioner of Patents and Trademarks*